United States Patent [19]

Bresson et al.

[11] Patent Number: 5,048,245

[45] Date of Patent: Sep. 17, 1991

[54] DOUBLE-GLAZING INSULATING PANEL

[75] Inventors: René Bresson, Gray; Guy Grossard, Chargey, both of France

[73] Assignee: S I M U, Gray, France

[21] Appl. No.: 594,952

[22] Filed: Oct. 10, 1990

[30] Foreign Application Priority Data

Oct. 20, 1989 [FR] France ..... 89 14092

[51] Int. Cl.[5] ..... E06B 7/12

[52] U.S. Cl. ..... 52/171; 160/26; 160/98

[58] Field of Search ..... 52/171; 160/310, 98, 160/25, 26, 107

[56] References Cited

U.S. PATENT DOCUMENTS

| | | | |
|---|---|---|---|
| 3,961,659 | 6/1976 | Siegel | 160/26 |
| 4,018,259 | 4/1977 | Herms | 160/26 |
| 4,197,896 | 4/1980 | Reichstadt | 160/26 X |
| 4,417,185 | 11/1983 | Bullat | 160/310 |
| 4,649,980 | 3/1987 | Kunz | 160/98 |

FOREIGN PATENT DOCUMENTS

| | | | |
|---|---|---|---|
| 154218 | 2/1984 | European Pat. Off. | 52/171 |
| 2743904 | 4/1979 | Fed. Rep. of Germany | 160/26 |

*Primary Examiner*—Richard E. Chilcot, Jr.
*Assistant Examiner*—Kien T. Nguyen
*Attorney, Agent, or Firm*—Dowell & Dowell

[57] ABSTRACT

A double-glazing insulation panel having a pair of panes which define an intermediate space in which is mounted a drum for use in vertically adjusting a screen and which the drive mechanism for the drum is removably mounted through an opening in the frame of the panel and supported relative thereto by a stopper assembly which is used to seal the opening through the frame.

11 Claims, 3 Drawing Sheets

DOUBLE-GLAZING INSULATING PANEL

BACKGROUND OF THE INVENTION

The present invention relates to double-glazing insulating panels.

HISTORY OF THE RELATED ART

For dressing facades, particularly in office buildings, modern architecture calls upon transparent panels appropriately fixed on a virtually invisible frame, such panels comprising two panes of glass, double-glazing, mounted in a tight manner on a peripheral chassis.

It is an object of the present invention to provide such panels with a motorized screen device directly incorporated inside the tight intermediate space formed between the double-glazing.

SUMMARY OF THE INVENTION

To that end, the invention consists essentially in providing the upper part of the the intermediate space with a cradle element forming an envelope for a rotating drum to which is secured the upper horizontal edge of a supple screen engaged through a longitudinal slot in the cradle element. The rotation of this drum in the two directions is accomplished by a drive mechanism introduced in the drum by axial slide from one of the ends thereof. The corresponding end of the drive mechanism is fixed in dismountable manner to a removable stopper tightly engaged in an opening made laterally in the chassis or frame of the panel.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1:
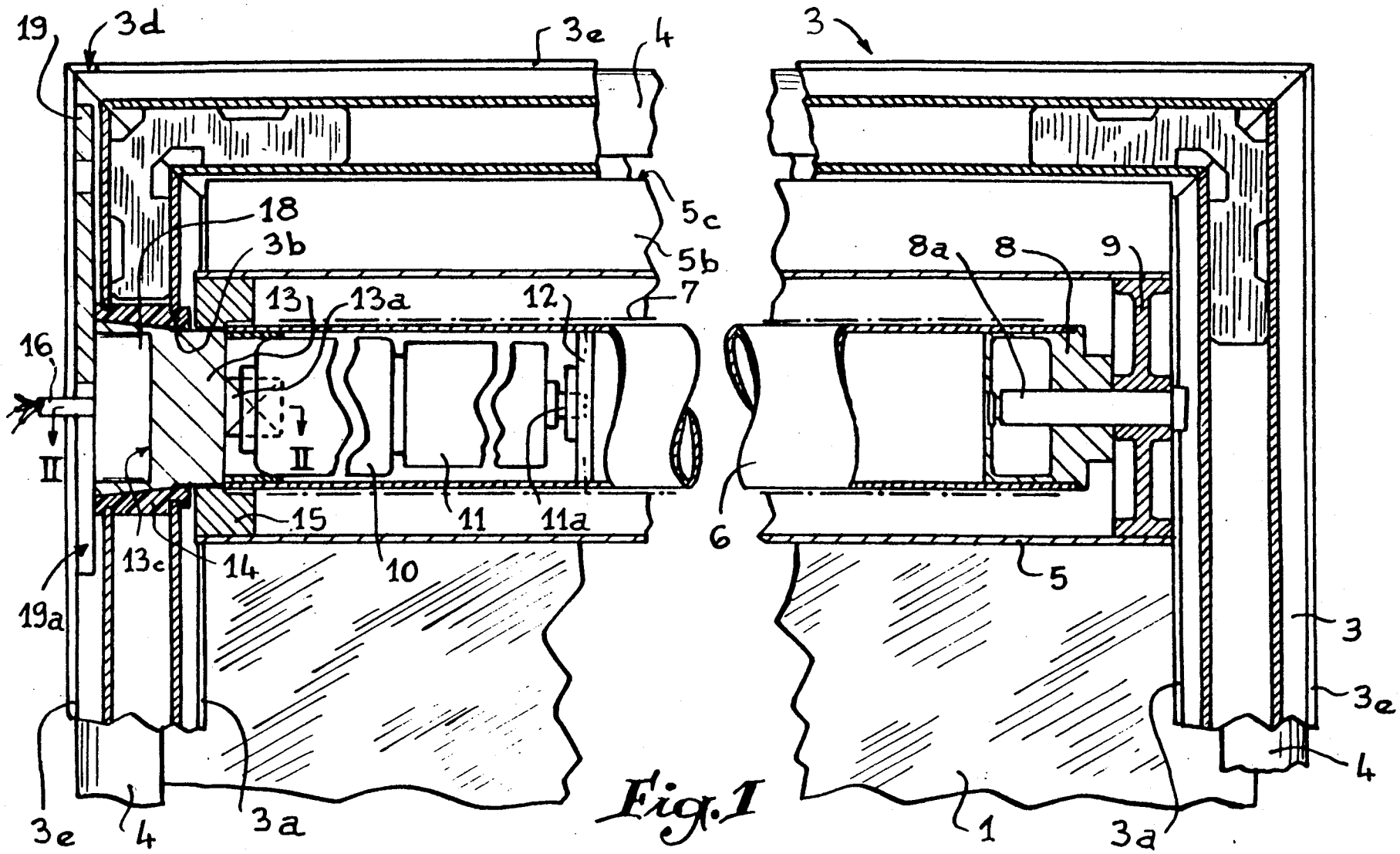
FIG. 1 is a schematic vertical section of the upper part of a panel according to the present invention.
Figure 2:
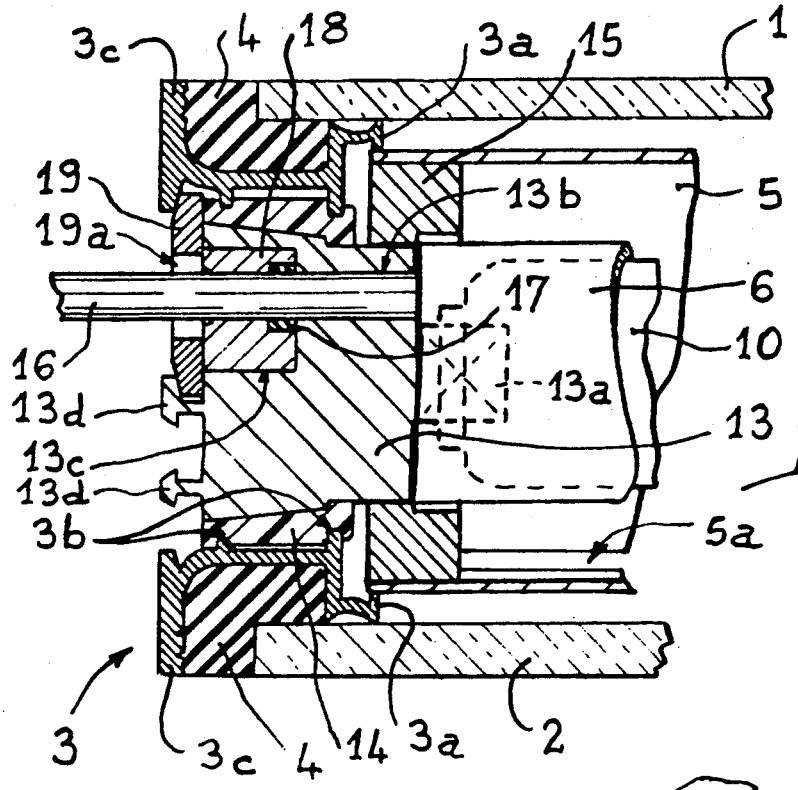
FIG. 2 is a horizontal section of a detail, on a larger scale, along the plane indicated at II—II in FIG. 1.

Referring now to the drawings, the insulating panel shown in FIGS. 1 and 2 comprises in manner known per se, two transparent sheets or panes 1 and 2 of which the edges are secured within a square or rectangular frame 3, with the interposition of O-rings 4. It will be observed that the thickness of this panel is slightly greater than that of the conventional panels of the same type, so that the intermediate space formed between the panes 1 and 2 is capable of receiving the motorized screen mechanism which will be described hereinbelow. Of course, the atmosphere of this intermediate space, treated to avoid any condensation, is sealed from the outside atmosphere.

Figure 3:
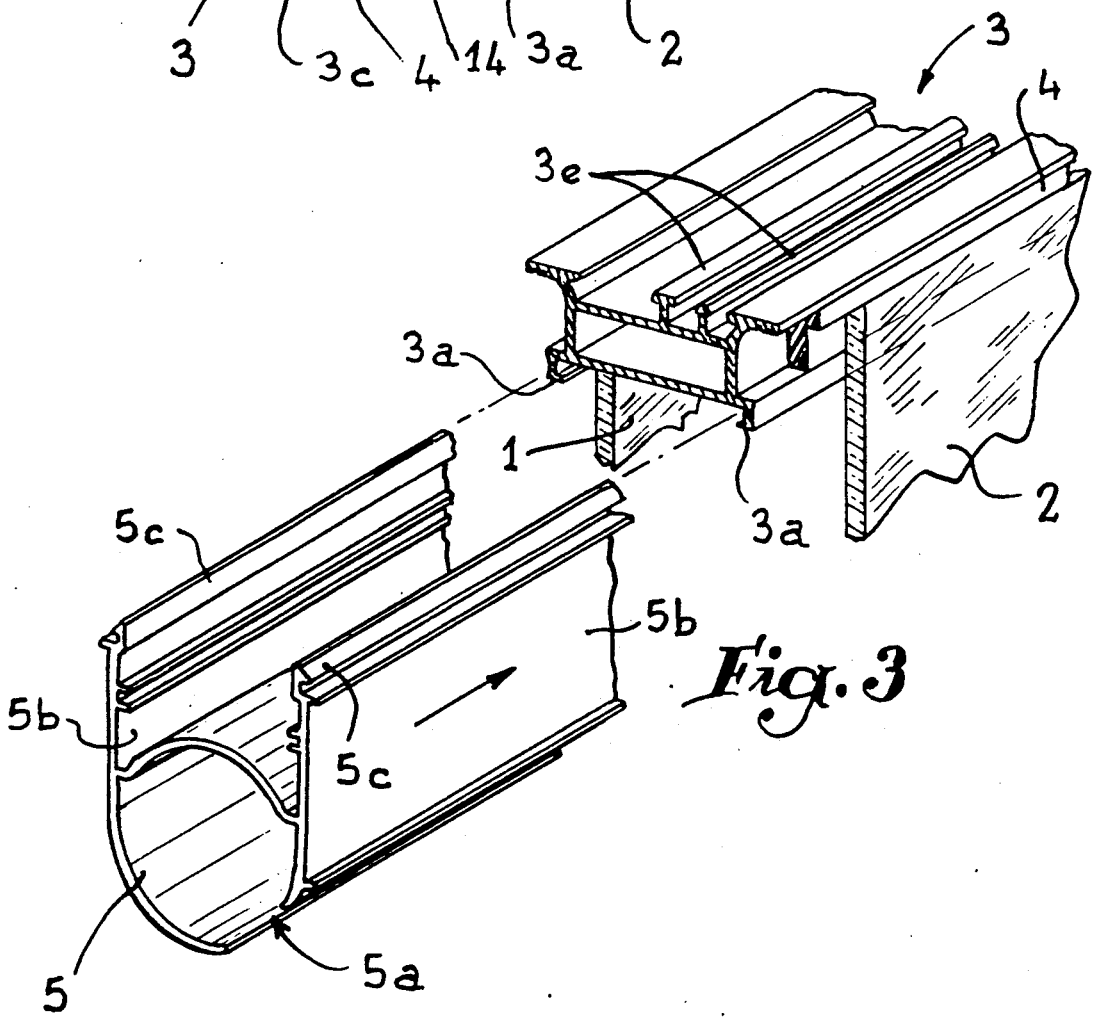
FIG. 3 illustrates in perspective the arrangement of the cradle element and its fixation inside the panel.

When the panel is constructed, it is provided with a cradle element 5 which, as shown in FIG. 3, is of substantially circular cross-section. The cradle element 5 includes a longitudinal slot 5*a* which extends over its entire length and which faces obliquely downwardly. Opposite this slot 5, the cradle element 5 is provided with two vertical extensions 5*b* of which the upper edge includes a flange 5*c* sectioned to from a longitudinal groove. This groove is adapted to cooperate, by axially sliding the cradle element 5, with two corresponding longitudinal guide flanges 3*a* provided at the inner face of a section of the frame consequently supporting of the cradle element in the frame.

In the cradle element 5 is mounted a winding drum 6, on the periphery of which is fixed the upper edge of a blind or like screen shown schematically at 7 in FIG. 1, which screen is engaged through the lower slot 5*a* so as to allow vertical displacement thereof inside the intermediate space, by rotation of the drum 6. The drum is centred in rotation in the cradle element 5; to that end, one of its ends is closed by an endpiece 8 mounted on a pin 8*a* on the projecting end of which is idly mounted a side element 9 of circular section, secured at its periphery to the inner wall of the cradle element 5.

Drum 6 is driven in rotation by a mechanism housed inside the drum and which comprises, in conventional manner, an electric motor 10 associated with a speed reducer 11. The driven shaft 11*a* of the reducer 11 is sectioned so as to be fitted, by axial displacement of assembly 10–11, inside the hub of a drive member 12 which is secured to drum 6.

Opposite reducer 11, the motor 10 is supported in removable manner inside the drum 6 by an endpiece 13*a* of square section, adapted to fit axially in the central part of the casing of the motor. This endpiece 13*a* is secured to a support 13 arranged in the manner of a removable stopper adapted to be engaged by force inside an annular seal 14 which is mounted inside an opening 3*b* provided laterally in the frame 3.

Figure 4:
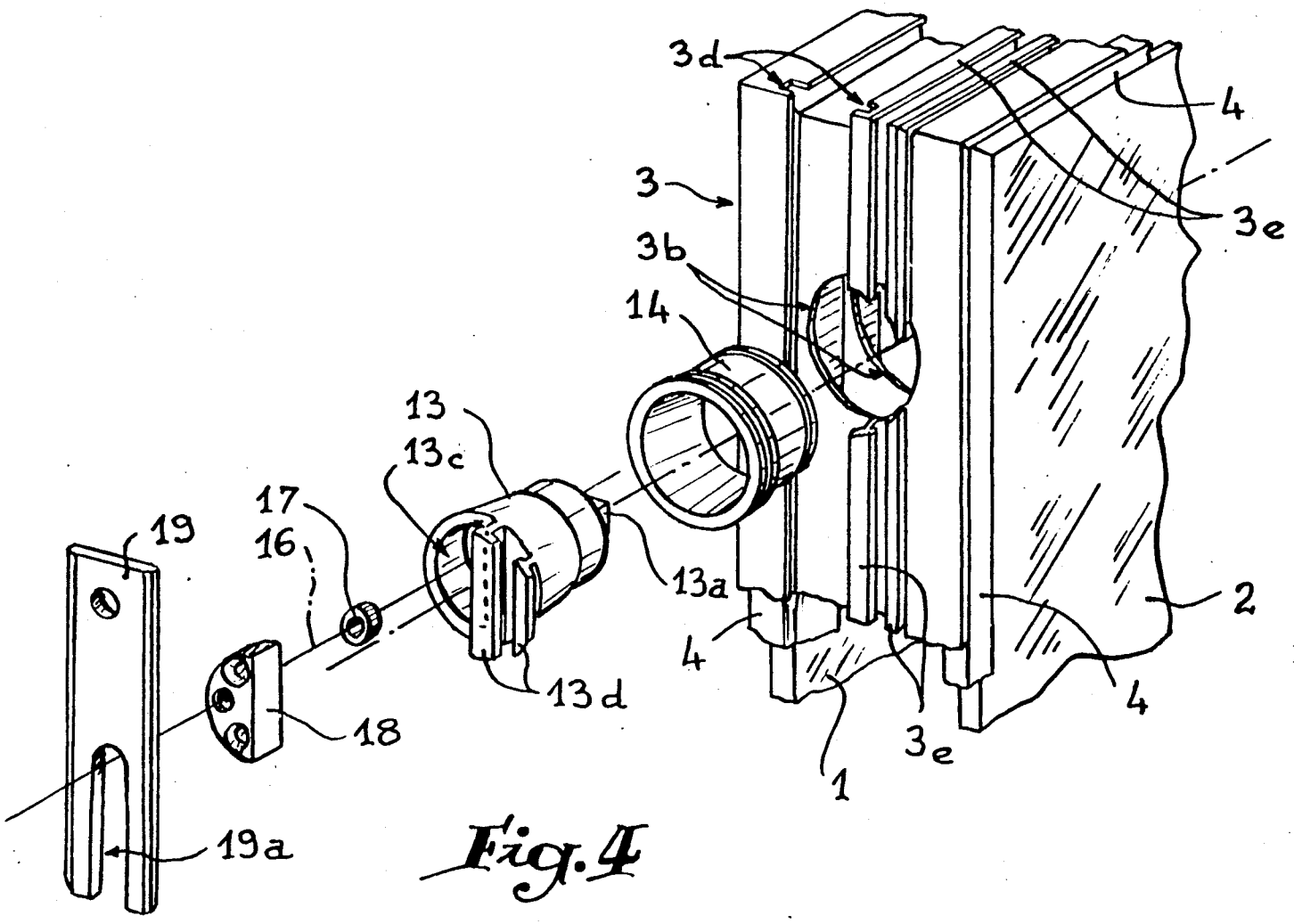
FIG. 4 shows in perspective and exploded, the elements which serve to obturate the opening made laterally in the frame for assembling the drive mechanism of the screen device.

FIGS. 2 and 4 clearly show the arrangement of the stopper 13 and seal 14. The axial opening of this seal 14 presents a truncated section to which corresponds on the stopper 13 a conjugate part, followed by a cylindrical axial extension adapted to engage in the opening of a guide ring 15 fitted by force inside the corresponding opening of the cradle element 5, which ring thus ensures the centering of the end of the drum 6.

For the passage of the cable 16 which provides electrical power to the motor 10, there is arranged in the stopper 13 a longitudinal bore 13*b* which must, of course, be rendered tight after assembly of motor-reducer assembly 10–11 in the drum 6. To that end, a bushing 17 is employed, made of a deformable material in order to serve as stuffing box. This bushing 17 is carried by a pusher 18 of half-moon section, introduced in a recess 13*c* in the stopper 13 and retained in place by screws.

To avoid any untimely axial displacement of stopper 13 once positioned with the pusher 18, the invention provides a key 19 having an elongated opening 19*a* cut therein, intended to overlap the cable 16. This key 19 is introduced, by vertically sliding from an inlet 3*d* (FIG. 4) made in the frame 3, in a recess defined by outer longitudinal ribs 3*e* of the frame.

It will be observed that the stopper 13 is advantageously provided, on its outer face, with projections 13*d* identical to ribs 3*e* of the outer face of the frame 3. Consequently, a continuous profile is obtained which allows the conventional seal associated with each panel to be positioned.

The advantages offered by the structure which has just been described will be readily understood. The insulating panel obtained is equipped with a motorized screen device which is incorporated in the panel and which can be manoeuvred by a reversible switch of conventional type, it being, however, noted that, in the case in question, adjustment of the ends-of-stroke of the screen must be able to be effected by means of the reversible switch mentioned. In the event of failure, the drive mechanism 10–11 may be replaced by extracting the key 19 and the stopper 13 with its pusher 18 and the stuffing box 17; after a new assembly has been positioned, the internal atmosphere is treated before closing of the opening of the frame by the stopper 13 and its related components.

What is claimed is:

1. In a double-glazing insulating panel having two panes sealed to a frame so as to create a space therebetween and wherein the frame includes upper and side walls the improvement comprising, a cradle element mounted in the spaces within the panel adjacent the upper wall, a rotatable drum having first and second end portions, a screen supported by said drum, an elongated slot in said cradle element through which said screen extends, a drive mechanism mounted within said drum, first mounting means for rotatably supporting said first end of said drum within said cradle element, means for drivingly connecting said drive mechanism to said drum, an opening in one of the side walls of the frame, said opening being axially aligned with said drum, said drive mechanism being selectively axially slidable relative to said drum through said opening, a stopper assembly removably mounted in sealing relationship within said opening, and said second end of said drum being supported within the panel by said stopper assembly.

2. The panel of claim 1 in which the upper wall of the frame includes opposing guide flanges, said cradle element including a pair of vertical extensions having upper portions which are slidably engagable with said guide flanges to thereby support said cradle element within the panel.

3. The panel of claim 1 in which said drive mechanism includes a motor having a casing having end portions, a recess in one of said end portions, said stopper assembly including an endpiece extending therefrom, said endpiece being engagable within said recess of said motor casing.

4. The panel of claim 3 in which said means for drivingly connecting said drive mechanism to said drum includes a drive member secured to said drum, a speed reducer drivingly connected to said motor and a drive shaft extending from said speed reducer into engagement with said drive member.

5. The panel assembly of claim 1 including an annular seal member disposed within said opening, said seal member defining a truncated inner opening, said stopper assembly including a truncated portion for cooperatively seating within said inner opening.

6. The panel of claim 5 wherein said cradle element includes an end opening adjacent said opening in the frame, a guide ring mounted within said end opening, and said stopper assembly being engagable within said guide ring.

7. The panel of claim 6 in which said drive mechanism includes a motor having a casing having end portions, a recess in one of said end portions, said stopper assembly including an endpiece extending therefrom, said endpiece being engagable within said recess of said motor casing.

8. The panel of claim 1 in which said first mounting means includes an end piece mounted within said first end portion of said drum, a pin means extending axially outwardly of said first end portion of said drum, said pin means having an outer end, a side element secured within said cradle element, and said outer end of said pin means being idly supported by said side element.

9. The panel of claim 1 including an electrical cord extending from said drive mechanism, a bore through said stopper assembly, and a pusher element and busing for securing said electrical cable within said bore.

10. The panel of claim 1 in which said one of said side walls includes outwardly extending ribs, said stopper assembly including an outer surface having projections thereon which are aligned with said ribs when said stopper assembly is seated within said opening.

11. The panel assembly of claim 10 including a key element disposed against said outer surface of said stopper assembly, and said key element being engagable between said ribs and said projections to thereby retain said stopper assembly within said opening.

* * * * *